US007413385B2

(12) United States Patent
Moroschan

(10) Patent No.: US 7,413,385 B2
(45) Date of Patent: Aug. 19, 2008

(54) FOAM PILE SYSTEM

(76) Inventor: Casey Moroschan, 10543-35 Avenue, Edmonton, Alberta (CA) T6J 2M1

( * ) Notice: Subject to any disclaimer, the term of this patent is extended or adjusted under 35 U.S.C. 154(b) by 683 days.

(21) Appl. No.: 10/762,304

(22) Filed: Jan. 23, 2004

(65) Prior Publication Data

US 2005/0081459 A1 Apr. 21, 2005

(30) Foreign Application Priority Data

Oct. 17, 2003 (CA) ..... 2443759

(51) Int. Cl.
*E02D 5/46* (2006.01)

(52) U.S. Cl. ..... 405/240; 405/229; 405/232; 405/233

(58) Field of Classification Search ..... 405/231, 405/232, 233, 236, 240, 241, 302.4
See application file for complete search history.

(56) References Cited

U.S. PATENT DOCUMENTS

| | | | | |
|---|---|---|---|---|
| 3,279,334 A | | 10/1966 | Quartararo | 94/7 |
| 3,822,955 A | | 7/1974 | Haferkamp et al. | 404/72 |
| 3,839,518 A | | 10/1974 | Rubens et al. | 264/45 |
| 3,986,781 A | | 10/1976 | Condo et al. | 404/31 |
| 4,167,356 A | | 9/1979 | Constantinescu | 404/31 |
| 4,358,223 A | | 11/1982 | Jahns et al. | 405/157 |
| 4,464,082 A | | 8/1984 | Isaacs | 405/157 |
| 4,668,121 A | | 5/1987 | Bosich | 404/72 |
| 4,818,148 A | * | 4/1989 | Takeda et al. | 405/234 |
| 5,079,895 A | | 1/1992 | Sinki | 52/743 |
| 5,181,797 A | * | 1/1993 | Circeo et al. | 405/131 |
| 5,279,502 A | * | 1/1994 | Goughnour | 405/237 |
| 5,494,514 A | | 2/1996 | Goodson et al. | 106/677 |
| 5,639,297 A | | 6/1997 | Stracke et al. | 106/677 |
| 6,316,074 B1 | | 11/2001 | Kaiser et al. | 428/76 |
| 6,387,479 B1 | | 5/2002 | Hayashi et al. | 428/297.4 |

FOREIGN PATENT DOCUMENTS

| | | | | |
|---|---|---|---|---|
| CA | 1210605 | | 9/1986 | 72/34 |
| CA | 2273345 | | 11/1997 | |
| CA | 2339287 | A1 | 9/1999 | |
| EP | 0 851 064 | * | 7/1998 | |
| EP | 1002903 | A1 | 5/2000 | |
| JP | 04015381 | | 1/1992 | |

OTHER PUBLICATIONS

Powerpile: A new and unique patented ground stabilisation and load transfer technology from Uretek. Test Report: The Performance of "The Uretek PowerPile"-method and comparison to "The Uretek Deep Injection"-method in soft clay. Tampere, Finland, Oct. 20, 2006; p. 1-37.
International Search Report from PCT/CA 03/00959.

* cited by examiner

*Primary Examiner*—Frederick L. Lagman

(57) ABSTRACT

In this invention, after a hole has been drilled or excavated, injection probe(s) are placed at appropriate depth(s), the excavated native materials are replaced with appropriately sized crushed rock or other natural or synthetic materials, and then a polymeric resin is injected through the probe(s) to encapsulate and bind the fill material, whereby upon curing the polymeric resin and fill material forms a foam friction pile. Such friction piles drilled or excavated adjacent to each other will form a foam sheet piling system. The foam piles can also be re-enforced using nylon, polypropylene, fiberglass, other synthetic or non-synthetic materials or combinations of these materials. The polymeric resin typically would comprise a high density closed cell, water resistant expanding two component polyurethane foam system.

22 Claims, 2 Drawing Sheets

FOAM PILE SYSTEM

BACKGROUND OF THE INVENTION

This invention relates to construction of friction piles or friction pile-like structures for supporting and under-pinning structures on stable and unstable base soils, and for construction of shoring system(s) in stable and unstable base soils as for example:

(A) preparation of foundation support systems for buildings, walks, bridge abutments, concrete roads, and other structures requiring a base support system;

(B) construction of an in-situ barrier to prevent collapse or sloughing of native soils within a delineated perimeter foot print or face where excavation is to be undertaken;

(C) construction of vertical support members in perma-frost or ice-lensed soils which bear the loading of residential, commercial, industrial buildings, pipelines, or any other structures requiring the utilization of this type of foundation support system;

(D) construction of an anchoring or pinning system to which road beds, walks, and other such structures can be anchored to prevent horizontal movement of base soils beneath these structures.

In typical construction of foundation support systems where piles are needed or where piles are needed to construct a structural floor or structural concrete slab, friction piles are employed. Friction piles are typically either of the driven or drilled type. The latter system employs the drilling of a predetermined size of hole which is filled with concrete and left to cure and thereby forming a friction pile. This pile may or may not be re-enforced with steel re-enforcing-bar. Alternatively, steel members, wooden timbers or poles, or synthetic members are manually driven into base soils to pre-determined depths with a resultant friction pile being formed. A system or array of such piles are put in place to support and eliminate or minimize future settlement of whatever structure is to be constructed on the system of piles.

In certain construction situations barriers are required to be driven into the base soils to prevent sloughing of base soils as the soils on one side of the barrier are excavated for a foundation, installation of a pipeline, etc. Typically, these barriers are sheets of steel that are mechanically driven into the base soils and which can be joined to each other through a tongue and groove like linkage at the ends of the steel sheets. Typically this is referred to as placement of sheet piling. The sheet piling can also be constructed of sheets of synthetic materials. Alternatively, steel, wooden or synthetic members or poles may be driven into base soils adjacent to each other to prevent sloughing.

Typically in base soils where perma frost or ice lensing is a condition, vertical support members are driven or drilled into the base soils to support a building, pipeline or other structure. Typically, wooded members are driven into the base soils to provide a friction pile. Wood members are used as the thermal conductivity of wood is low. Steel members can also be used but steel has a high thermal conductivity and more susceptible to result in settlement as heat is transferred through the steel member and the perma frost degrades. Vertical support members can also be installed by firstly drilling a hole, inserting a wooden or metal member and back filling around the member with a slurry which either freezes in place or sets up and cures in the case of certain cementitious slurries.

Under certain construction circumstances, friction piles can be used to tie-in adjacent horizontal structures such as gravel, asphalt concrete or concrete roads to prevent them from moving. Movement of such structures is typically as a result of a slip face in the base soils that may be caused by perma-frost or ice lenses.

The construction of typical friction piles for use in foundation construction or the construction of structural slabs and in the construction of vertical support members have certain inherent problems or negative characteristics such as:

A) In the case of friction piles which are drilled and the drilled hole is filled with concrete, the very heavy weight of the concrete must also be taken into account in calculating the load relative to the anticipated holding strength of the friction pile. Typically the piles have to be drilled deeper to take into account the fairly considerable additional weight of the pile itself.

B) Maximum friction or holding strength is achieved when as much of the surface of the concrete pile comes into contact with the wall of the drilled hole. This "contact" is not maximized whenever there is an occlusion in the wall of the concrete pile.

C) Concrete as a cementitious material is made with water and as such is susceptible to shrinkage as the concrete cures and any shrinkage of the concrete will lessen the skin friction of the pile. Curing time can also be a mitigating factor in slowing up the next stage of construction after the friction piles have been poured in place.

D) It is not atypical for piles to have to permeate a number of different strata of base soils and wherever the pile goes through a weak strata, the skin friction in this area will be significantly less thereby reducing the overall holding capacity of the pile and requiring a deeper pile to overcome this condition.

E) Wooden vertical support members although having a relatively low coefficient of heat transference, heat will still transfer through the wood and when placed in a perma-frost or ice-lens condition, eventual degradation of the perma-frost will occur

SUMMARY OF THE INVENTION

The present invention is directed to providing an alternative to drilled or driven friction pile systems. Therefore, according to an aspect of the invention there is provided a method of construction, comprising the steps of forming a volume of loose granular material in a base soil, such as permafrost soil; injecting a polymeric resin into the volume of loose granular material; and allowing the polymeric resin to cure and form a structural support within the base soil. Various methods may be used to form a volume of loose granular material, such as agitation of a base soil, or filling a constructed hole. Polymeric resin may be injected using a probe, which may be removed from the volume of loose granular material during injection. A pile or barrier formed by the method is also claimed.

According to a further aspect of the invention, a method of construction is provided that comprises the steps of drilling or excavating a hole, inserting injection probes, back-filling the hole or excavation with natural or synthetic granular material and then injecting a polymeric resin into the granular fill, whereby upon curing the resultant mass forms a friction pile which will support a structure and prevent or minimize settlement due to the weight of the structure. In the case of base soils comprising sand, silt or gravels, it may only be necessary to "agitate" these base soils to freely allow the polymeric resins to expand and encapsulate the soils and thus form the friction pile in situ.

According to another aspect of the invention, a method of construction is provided comprising the drilling of a number of holes adjacent to each other, inserting injection probes, backfilling the hole with natural or synthetic granular material and then injecting a polymeric resin into the granular fill, whereby upon curing the resultant mass forms a barrier or "sheet pile" where-upon excavation on either side of the barrier will prevent sloughing of base soils into the excavated area. Where unstable base soils comprising sands, silts and gravels are a condition, "agitation" of these types of base soils will be required to freely allow the polymeric resins to expand and encapsulate the soils and thus form the pile in situ.

According to another aspect of the invention, a method of construction is provided comprising the drilling or excavation of a hole in unstable base soils, inserting a wooden, metallic or synthetic member in the hole, inserting injection probe(s) in the hole adjacent to or around the member, backfilling the hole with natural or synthetic granular material and then injecting a polymeric resin into the fill, whereby upon curing the resultant mass is a stabilized vertical support member resistant to heat transference into unstable soils where perma frost and ice lensing is a condition.

Various applications of the method of construction include construction of structures built on pile and beam foundations, concrete structural floor slabs, bridge abutments, concrete roads, walks, tarmacs, runways, retaining wall structures to prevent sloughing and collapse of soils under excavation, and vertical support members supporting above grade structures and facilities such as building structures, walks, pipelines and utilities services.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which the numerals denote like elements and in which.

DETAILED DESCRIPTION OF PREFERRED EMBODIMENTS

In this patent document, "comprising" means "including". In addition, a reference to an element by the indefinite article "a" does not exclude the possibility that more than one of the element is present. "Loose" in relation to granular material means that the granular material is not cemented together and the grains of the granular material are free to move in relation to each other to allow liquid polymeric resin to move around the grains. Granular material may be natural, such as silt, sand, gravel, rock fragments and construction rubble, or synthetic, such as granulated rubber, as may be obtained from breaking up used tires.

Figure 1:
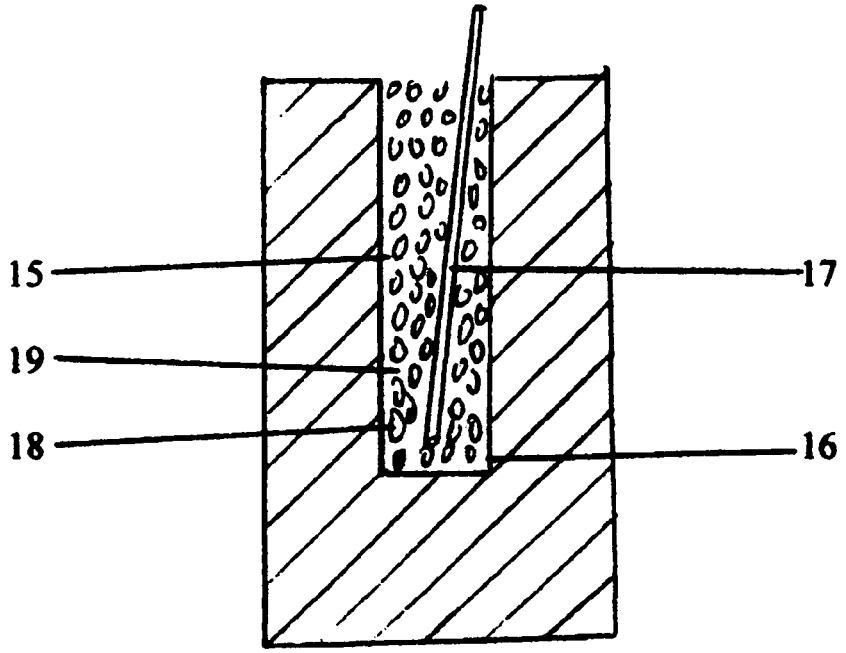
FIG. 1 is a section through a foam pile for use as a foundation support in the construction of building foundations, bridge abutments, concrete slabs-on-grade, and other structures requiring a piling system to carry the load of a structure and prevent settlement according to the invention.
Figure 2:
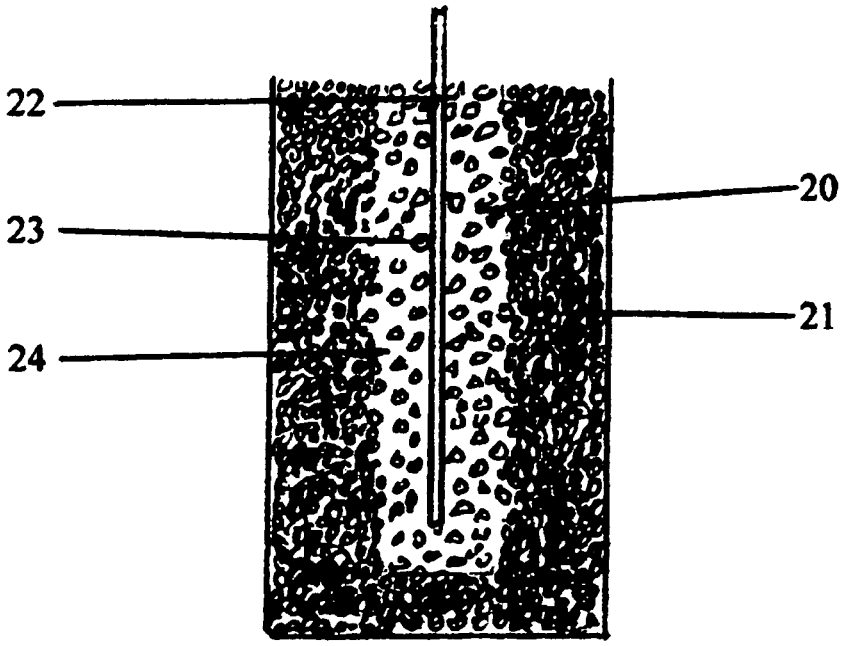
FIG. 2 is a section through a foam pile constructed in highly compacted soils comprising silts and/or sands and/or gravels for use as a foundation support in the construction of building foundations, bridge abutments, concrete slabs-on-grade, and other structures requiring a piling system to carry the load of a structure and prevent settlement according to the invention.

A foam friction pile is used in supporting and under-pinning the foundation systems of new and retro-fitted residential, commercial and industrial structures; in the construction of structural slabs in residential, commercial, industrial and roadway applications. FIGS. 1 and 2 illustrate alternative procedures for forming a volume of loose granular material into which a polymeric resin may be injected, which, upon curing, forms a structural support. In the one case, the volume is created by excavation or drilling, followed by filling, and in the other by agitation of in situ base soils.

A variation of the foam friction pile is used in the construction of an in-situ barrier or retaining wall to depth to allow for ready excavation for basements, pipeline trenches, utilidors, other sub-grade structures and for the stabilization of weak base soils to allow for specialized drilling procedures such as the drilling of bell piles.

A similar procedure to constructing a foam friction pile is applicable in the construction of vertical support members which will support residential, commercial and industrial structures, walkways, oil and natural gas pipelines and other utilities pipelines all above grade.

The foam friction pile, as in the case of conventional drilled or driven pile systems, is intended to prevent or minimize settlement of structures constructed on the pile(s). As in the case of conventional, poured in place piling systems, the foam friction pile may be re-enforced with steel or other specified material as required by the engineer.

In an embodiment of this invention and in regards to unstable base soils where agitation of the base soils is required to allow effective expansion and encapsulation of these base soils, the process of agitating the soils may be undertaken by mechanical means such as drilling, vibro-drilling and seismic and/or, the use of water, sound, electromagnetic forces or other means that will agitate or loosen these base soils.

The polymeric resin is preferably a high density, two part, closed cell, hydro-insensitive and insulative expanding polymer resin, such as a polyurethane system, which is injected into the fill material or agitated base soils to achieve a foam pile. The particular foam system used is tailored to meet specific design applications relating tensile strength, compressive strength, shear strength, flexural strength and other structural characteristics to meet the specific design applications of the foam pile for any given project. It is also possible to use other expandable substances having similar properties.

FIG. 1 shows a foam pile 15 for use in the construction of a foundation support system for building foundations, bridge abutments, structural concrete slabs-on-grade or the like. A hole 16 is drilled or excavated into the base soils, an injection probe 17 is inserted into the hole and sized natural or synthetic granular material 18 is back-filled into the excavation and an expanding polymer resin 19 is injected into the granular fill 18 permeating same in-total and binding the granular fill 18 to give a contiguous mass of material strong enough to support the load of the structure to be constructed on this type of piling system.

Figure 3:
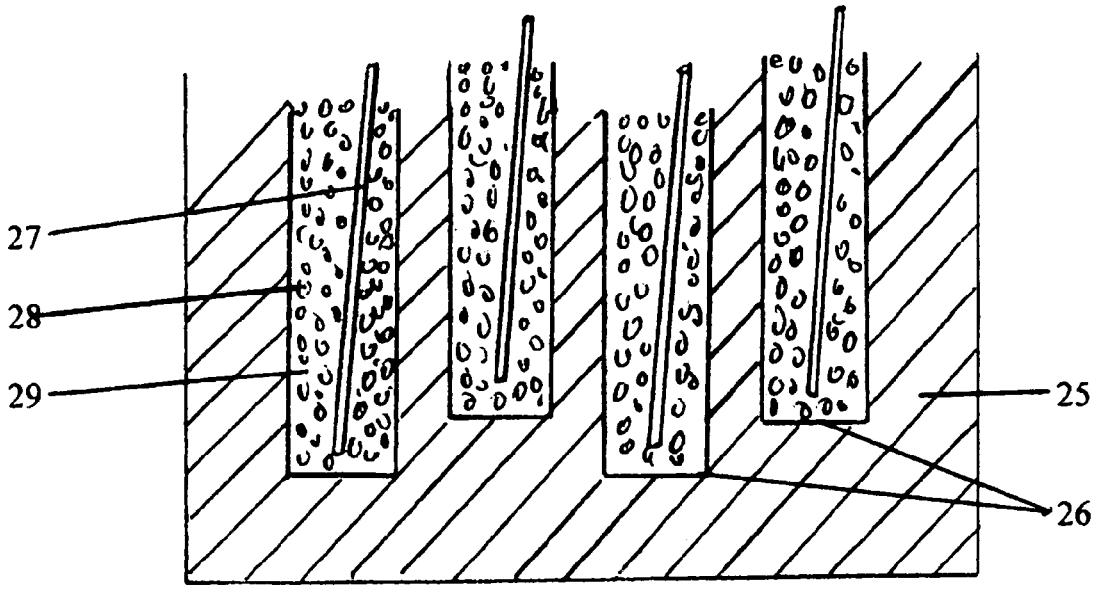
FIG. 3 is a section through an array of foam piles drilled in a pre-determined pattern and constructed to form a barrier, or wall or shoring system to allow for excavation or drilling on one side of the barrier and prevent sloughing of base soils into the excavated or drilled area according to the invention.

FIG. 2 shows a foam pile 20 for use in the construction of a foundation support system for building foundations, bridge abutments, structural concrete slabs-on-grade or the like. This design is for the construction of foam piles 20 in unstable base soils comprising silts and/or sands and/or gravels that are compacted. The compacted base soils 21 are agitated to loosen and break up same by mechanical, hydraulic, pneumatic, seismic or other means. An injection probe 22 is inserted into the agitated soils 23 and an expanding polymer resin 24 is injected into the agitated base soils 23 permeating same in-total and binding them to give a contiguous mass of material strong enough to support the load of the structure designed to be constructed on this type of piling system FIG. 3 shows an array of foam piles 24 for use in the construction of a shoring structure or barrier wall to allow for excavation of basements, utilidors, trenches and the like and thereby retain the base soils 25 from sloughing or caving into the excavation. Holes 26 are drilled or excavated into the base soils 25, injection probes 27 are inserted into the holes and sized natural or synthetic granular material 28 is back-filled into the excavations and an expanding polymer resin 29 is injected into the granular fill 28 permeating same in-total and binding the granular fill 28 to give a contiguous mass of material strong enough to form a barrier wall or shoring structure to allow for excavation on either side of the barrier wall or shoring structure.

Figure 4:
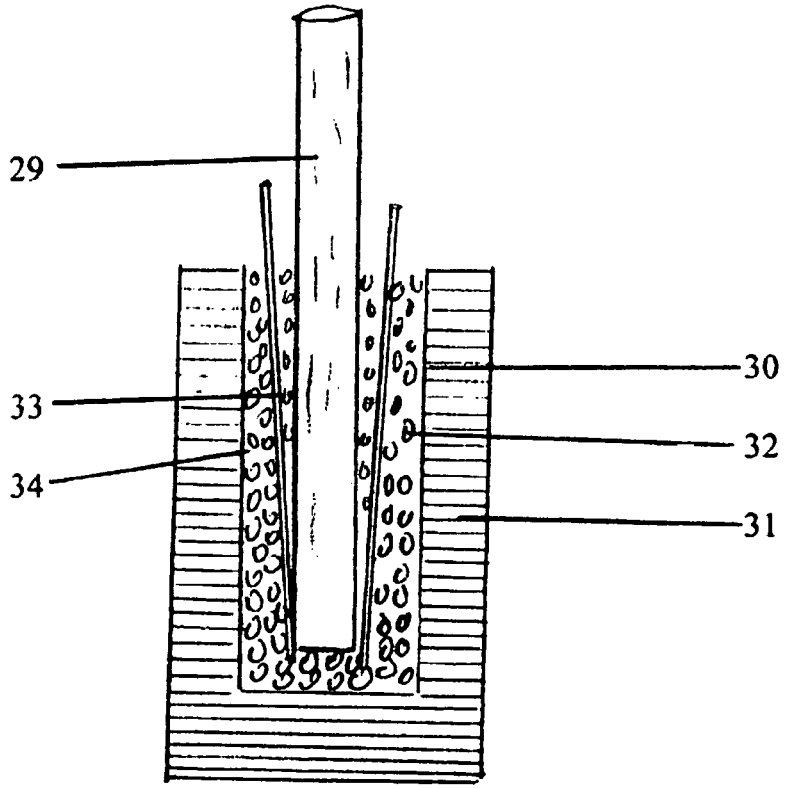
FIG. 4 is a section through a system for fixing and stabilizing vertical support systems excavated into stable and/or unstable soils according to the invention.

FIG. 4 shows a variation of the invention where a pile or vertical support member 29 made of wood, metal or synthetic material is inserted into an excavated or drilled hole 30 into base soils 31 which are stable or unstable but particularly relevant to unstable base soils 31 such as perma-frost or ice-lensed base soils. Natural or synthetic sized granular material 32 placed at the bottom of the drilled hole 30, injection probe(s) is/are inserted into the drilled hole 30, the pile or vertical support member 29 is placed in the drilled or excavated hole 30 and granular material 32 is back-filled around the pile or vertical support member 29 and the injection probe(s) 33 and an expanding polymer resin 34 is injected into the granular fill 32 binding the granular fill 32 to give a contiguous mass of material stabilizing the pile or vertical support member 29 in the drilled hole.

The high density, two part, hydro-insensitive expanding polymeric resin is either injected at the base of the pile thereby allowing the resin to expand and encapsulate the agitated base soils or pile fill from the bottom of the pile upwards, a technique applicable for relatively short foam pile requirements where loads are relatively light; or in the case of deeper foam piles, the injection probe is slowly pulled out as the resin is injected into the agitated base soils or fill material. The polymeric resin expands and encapsulates the agitated base soils or fill material thereby forming a friction pile. Further, since the polymeric resin is liquid in form when it is injected and since it aggressively expands it fills all depressions in the wall of the excavation where the foam pile is being constructed thereby enhancing the overall strength of the foam pile.

Another positive benefit is the polymeric resin has relatively high thermal characteristics and in the case of foam piles or supporting and stabilizing vertical support members in perma frost or ice lensed soils conditions, this contributes significantly to minimizing degradation of the perma frost or ice lens due to heat loss. Depending upon he density of the polymeric resin, it could have an insulative R-value in the orders of R4-R5.5.

Another positive benefit of the foam pile is that the expanding polymer resin is light weight weighing in the range of 220-300 lbs. per cubic meter. Further, since the polymer will be closed cell, water permeation is not a consideration and therefore the effects of freeze/thaw cycling will not impact the foam pile.

Immaterial modifications may be made to the invention described here without departing from the invention.

The embodiments of the invention in which an exclusive property or privilege is claimed are defined as follows:

1. A method of construction, comprising the steps of:

forming a volume of loose granular material in a base soil;

injecting a polymeric resin into the volume of loose granular material, the polymeric resin being an expanding polymeric resin and permeating the volume of loose granular material upon injection into the loose granular material; and allowing the polymeric resin to cure and bind the loose granular material together to form a structural support within the base soil, the structural support being formed of a contiguous mass of granular material permeated by polymeric resin.

2. The method of claim 1 in which forming a volume of loose granular material comprises:

forming a hole in the base soil; and placing loose granular material in the hole.

3. The method of claim 2 in which injecting a polymeric resin into the volume of loose granular material comprises:

inserting a probe into the hole and injecting polymeric resin into the bottom of the hole using the probe.

4. The method of claim 3 in which injecting polymeric resin into the hole comprises removing the probe from the hole while injecting polymeric resin.

5. The method of claim 1 in which forming a volume of loose granular material comprises:

agitating a granular base soil.

6. The method of claim 5 in which injecting a polymeric resin into the volume of loose granular material comprises:

inserting a probe into the volume of agitated granular base soil and injecting polymeric resin through the probe.

7. The method of claim 6 in which injecting polymeric resin into the hole comprises removing the probe from the volume of agitated granular base soil while injecting polymeric resin.

8. The method of claim 1 in which the base soil is a permafrost soil.

9. The method of claim 1 in which the polymeric resin expands upon injection into the loose granular material to encapsulate the loose granular material.

10. The method of claim 1 in which the granular material comprises one or more of silt, sand, gravel, rock fragments or construction rubble.

11. The method of claim 1 in which the granular material comprises a synthetic material.

12. The method of claim 1 in which the polymeric resin is a two part hydro-insensitive expanding polymeric resin.

13. A construction pile formed by the method of claim 1.

14. A construction barrier formed by application of the method of claim 1 at plural locations adjacent to each other in a base soil.

15. A method of construction, comprising the steps of: excavating to predetermined depth an excavation by drilling or other conventional excavation techniques; and placing an injection probe or probes into the excavation; and back-filling the excavation with granular material formed of pre-determined sized crushed rock or gravel; and injecting the back-filled material with a polymeric resin, the polymeric resin being an expanding polymeric resin, whereby upon curing, the polymeric resin and granular material forms a structural friction pile.

16. The method of claim 15 in which the friction pile supports a foundation be it pile and beam construction or concrete slab-on-grade.

17. The method of claim 15 in which vertical support structures are constructed in perma frost or ice lenses.

18. The method of claim 15 in which the polymeric resin is a two part hydro-insensitive expanding polymeric resin.

19. The method of claim 15 repeated to form a predetermined and patterned array of friction piles that forms a structural barrier similar to sheet piles.

20. A method of construction, comprising the steps of agitating a base soil; placing an injection probe or probes into the agitated base soil; and injecting the agitated soils with a polymeric resin, the polymeric resin being an expanding polymeric resin, whereby upon curing, the expanding polymeric resin and agitated granular material forms a structural friction pile.

21. The method of claim 20 in which the expanding polymeric resin is a closed cell, hydro-insensitive two part polymer resin injected into the agitated base soils.

22. The method of claim 20 in which agitating the base soils is accomplished by mechanical-vibratory drilling and/or hydraulic means and/or pneumatic means and/or sound waves and/or any other means that may now or later be developed which will agitate and break up base soils.

* * * * *